US007028419B2

(12) United States Patent
Brooks

(10) Patent No.: US 7,028,419 B2
(45) Date of Patent: Apr. 18, 2006

(54) FOOTWEAR

(75) Inventor: Jeffrey S. Brooks, St. Louis County, MO (US)

(73) Assignee: Jeffrey S. Brooks, Inc., Creve Coeur, MO (US)

( * ) Notice: Subject to any disclaimer, the term of this patent is extended or adjusted under 35 U.S.C. 154(b) by 116 days.

(21) Appl. No.: 10/730,354

(22) Filed: Dec. 8, 2003

(65) Prior Publication Data

US 2004/0111923 A1 Jun. 17, 2004

Related U.S. Application Data

(63) Continuation-in-part of application No. 09/921,957, filed on Aug. 3, 2001, now Pat. No. 6,671,981.

(60) Provisional application No. 60/223,437, filed on Aug. 4, 2000.

(51) Int. Cl.
*A43B 7/20* (2006.01)

(52) U.S. Cl. ..... 36/89; 36/93

(58) Field of Classification Search ..... 36/88, 36/89, 71, 93

See application file for complete search history.

(56) References Cited

U.S. PATENT DOCUMENTS

| | | | |
|---|---|---|---|
| 1,020,160 | A | 3/1912 | Rowe |
| 1,055,768 | A | 3/1913 | Levee et al. |
| 1,137,092 | A | 4/1915 | Sharp |
| 1,958,619 | A | 5/1934 | Handler |
| 2,061,540 | A | 11/1936 | MacDonald et al. |
| 2,075,552 | A | 3/1937 | Stemmons |
| 2,119,807 | A | 6/1938 | Farley |
| 2,261,041 | A | 10/1941 | Tennant |
| 2,312,911 | A | 3/1943 | Jewtraw |
| 2,332,473 | A | 10/1943 | Salander |

(Continued)

FOREIGN PATENT DOCUMENTS

| | | | |
|---|---|---|---|
| EP | 0 350 517 | A1 | 1/1990 |

(Continued)

OTHER PUBLICATIONS

International Search Report, Dated Apr. 21, 2005, 3 Pages.

(Continued)

*Primary Examiner*—M. D. Patterson
(74) *Attorney, Agent, or Firm*—Senniger Powers

(57) ABSTRACT

Footwear comprising a sole for supporting a foot and an upper attached to the sole for covering the foot and adjoining ankle. The sole and upper define an interior of the footwear and is sized and shaped for receiving the foot and ankle. The upper has an outer shell that forms an exterior of the footwear and an inner lining that is adjacent the foot and ankle when they are received in the interior of the footwear. A compressible generally U-shaped pad is positioned between the shell and the lining of the upper. The pad has a bottom section and a pair spaced-apart side sections extending up from the bottom section. The pad is sized and positioned in the upper such that when the foot and ankle are received in the footwear, the bottom section of the pad is disposed immediately below a medial malleolus of the foot and the side sections of the pad extend up along opposite sides of the medial malleolus up to at least about the distal neck of the tibia. Upon movement of the foot and ankle in the footwear, the pad is adapted to apply an intermittent pressing force to tissue of the ankle below and on opposite sides of the medial malleolus to reduce swelling of the ankle. A U-shaped pad for the opposite (lateral) side of the ankle may also be provided.

12 Claims, 15 Drawing Sheets

U.S. PATENT DOCUMENTS

| | | | | | |
|---|---|---|---|---|---|
| 2,821,032 | A | | 1/1958 | Helfet | |
| 2,828,555 | A | | 4/1958 | Ledos | |
| 2,918,059 | A | | 12/1959 | Levitt | |
| 2,918,734 | A | | 12/1959 | Hyde | |
| 3,068,872 | A | | 12/1962 | Brody | |
| 3,309,797 | A | | 3/1967 | Poitras | |
| 3,333,353 | A | | 8/1967 | Garcia | |
| 3,419,974 | A | | 1/1969 | Lange | |
| 3,726,287 | A | | 4/1973 | Wikler | |
| 3,750,310 | A | | 8/1973 | Messner et al. | |
| 4,272,899 | A | | 6/1981 | Brooks | |
| 4,435,910 | A | | 3/1984 | Marc | |
| 4,495,942 | A | * | 1/1985 | Palumbo | 602/27 |
| 4,503,576 | A | | 3/1985 | Brown | |
| 4,537,556 | A | * | 8/1985 | Tharp | 414/725 |
| 4,590,932 | A | * | 5/1986 | Wilkerson | 602/65 |
| 4,627,178 | A | | 12/1986 | Sullivan et al. | |
| 4,633,877 | A | | 1/1987 | Pendergast | |
| 4,702,255 | A | | 10/1987 | Schenkl | |
| 4,704,808 | A | | 11/1987 | Bianchini et al. | |
| 4,719,926 | A | | 1/1988 | Nelson | |
| 4,726,126 | A | | 2/1988 | Bernhard | |
| 4,739,765 | A | | 4/1988 | Sydor et al. | |
| 4,864,739 | A | | 9/1989 | Maestri | |
| 4,869,001 | A | | 9/1989 | Brown | |
| 4,876,806 | A | | 10/1989 | Robinson et al. | |
| 4,879,821 | A | | 11/1989 | Graham et al. | |
| 4,882,856 | A | | 11/1989 | Glancy | |
| 4,901,390 | A | | 2/1990 | Daley | |
| 4,977,691 | A | | 12/1990 | Orchard, 3rd | |
| 5,000,195 | A | * | 3/1991 | Neal | 602/27 |
| 5,067,257 | A | | 11/1991 | Coomer | |
| 5,092,347 | A | | 3/1992 | Shaffer et al. | |
| 5,146,698 | A | | 9/1992 | Tilles et al. | |
| 5,185,000 | A | * | 2/1993 | Brandt et al. | 602/63 |
| 5,384,973 | A | | 1/1995 | Lyden | |
| 5,408,761 | A | | 4/1995 | Gazzano | |
| 5,823,195 | A | * | 10/1998 | Shook et al. | 128/893 |
| 5,924,218 | A | | 7/1999 | Dalvy et al. | |
| 6,012,726 | A | | 1/2000 | Grande et al. | |
| 6,023,857 | A | | 2/2000 | Vizy et al. | |
| 6,041,524 | A | | 3/2000 | Brooks | |
| 6,442,875 | B1 | * | 9/2002 | Joubert et al. | 36/115 |
| 2002/0020081 | A1 | | 2/2002 | Brooks | |
| 2003/0093923 | A1 | | 5/2003 | Joubert et al. | |
| 2003/0154627 | A1 | | 8/2003 | Hirayama | |

FOREIGN PATENT DOCUMENTS

| | | |
|---|---|---|
| EP | 0 350 517 B1 | 1/1990 |
| FR | 1.222.370 | 6/1960 |
| FR | 2.015.914 | 4/1970 |
| GB | 217833 | 6/1924 |

OTHER PUBLICATIONS

Brooks, Visser and Duddy, "Mid-West Podiatry and Associates, Inc.", brochure, 8 pages.

COMED, *The Power of 78*, "Podiatry Today", Oct. 1993, p. 39.

Bloch Orthotic Labs, *Shelling Out Too Much for Orthotics?*, "Podiatric Products", Sep. 1994. p. 10.

IPOS Orthopedics Industry, *Soft-Base Soft-Ipocon*, "Podiatric Products", Sep. 1994, p. 37.

M-F Athletic Company, *If Achilles Was Alive, He'd Want a Pair of M-F Heel Protectors*!, "Podiatric Products", Sep. 1994, p. 55.

Johnson & Johnson, *Biomechanics*, "Biomechanics", Sep. 1995, p. 1.

Rieken's Orthotics Laboratory, *Our Dealers Become Old Friends. . .* , "Biomechanics", Sep. 1995, p. 16.

DARCO, *The One Stop Footcare Shop*, "Biomechanics", Sep. 1995, p. 18.

IEM Medical Technologies, *Sorbothane II Heel Cups*, "Biomechanics", Sep. 1995, p. 66.

Bio-Orthopaedic Laboratory, *Standard Foot Orthotics*, "Biomechanics", Sep. 1995, p. 76.

The Foot Store, *The Best Kind of Support. . .* , "Biomechanics", Sep. 1995, p. 76.

STJ Orthotic Services Inc., *Your Heel Pain Patients Will be Floating on Water*, "Podiatry Management", Jun. 1996, p. 1.

The Elford Group LTD., *Nothing Fits Like SOCS*, "Podiatry Management", Jun. 1996, p. 47.

CJ Foot Orthotics, *All This for Less*, "Podiatry Management", Jun. 1996, p. 101.

Bauerfiend, *Viscoheel, the viscoelastic heel cushions . . .* , "Biomechanics", Jan. 1997, p. 57.

Ortho-Dynactive, Inc., *Tread Lightly*, "Biomechanics", Jan. 1997, p. 71.

Bird & Cronin, Inc., *A Complete Line of Pre-Molded Silicone Foot Orthotics*, "Biomechanics", Jun. 1997, p. 44.

Bolt Systems, Inc., *Quality Prefabricated Orthopaedic Appliances*, "Biomechanics", Jun. 1997, p. 74.

SILIPOS, *MOVE*, "Biomechanics", Jun. 1997, p. 87.

Dr. Scholl's, *Now Your Patients Are One Step Closer to Pain Relief*, "Podiatry Today", Jul./Aug. 1997, p. 33.

ALIMED, *Your Best Single Source. . .* , "Podiatry Today", Jul./Aug. 1997, p. 43.

Performance Materials Corporation, *Into the Deep Blue*, "Podiatry Today", Jul./Aug. 1997, p. 44.

Allied OSI Labs, *Allied OSI Footlights are Light in Price*, "Podiatry Today", Jul./Aug. 1997, p. 84.

* cited by examiner

FOOTWEAR

CROSS-REFERENCE TO RELATED APPLICATION

This application is a continuation-in-part of U.S. patent application Ser. No. 09/921,957 filed Aug. 3, 2001 Now U.S. Pat No. 6,671,981, which claims priority from U.S. Provisional Patent Application Ser. No. 60/223,437 filed Aug. 4, 2000.

BACKGROUND OF THE INVENTION

The present invention relates generally to footwear, and more particularly to footwear having recesses for accommodating protrusions of the foot and/or one or more pads for reducing swelling of the ankle.

As illustrated in FIGS. 1–3, typical human feet, designated by the reference character O, have protrusions resulting from skeletal structures beneath the skin. For example, a head H1 of a first metatarsal M1 and a base B1 of a first proximal phalanx P1 cause a protrusion at a base of a first toe T1 (i.e., the great toe) which extends from the foot in a medial direction X1 (i.e., toward a centerline of the body) as shown in FIG. 2. A head H5 of a fifth metatarsal M5 and a base B5 of a fifth proximal phalanx P5 cause a protrusion at a base of a fifth toe T5 which extends from the foot in a lateral direction X2 (i.e., away from the centerline of the body). Further, the fifth proximal phalanx P5 of the fifth toe T5 extends farther laterally than a fifth middle phalanx MP5 and a fifth distal phalanx DP5 so the proximal phalanx forms a protrusion on the fifth toe immediately in front of the protrusion caused by the head H5 of the fifth metatarsal M5 as shown in FIG. 2. Several protrusions are caused by metatarsal and mid-tarsal bones MT which protrude upward from the top of the foot O as shown in FIG. 1. Further, in the ankle area the tibia T has a protrusion called the medial malleolus MM that is located at the medial side of the distal head of the tibia. Similarly, the fibula F has a protrusion called the lateral malleolus LM that is located at the lateral side of the distal head of the fibula.

Typical footwear has an upper attached to a sole. The upper surrounds the foot O to retain it in position inside the footwear when walking or running. As the foot O moves inside the footwear, the upper exerts pressure on features of the foot including the previously described protrusions. The protrusions also move relative to the upper, causing friction between the upper and the skin covering the protrusions. Sometimes the pressure and friction cause ailments such as swelling and irritation of the skin and underlying tissue. Some conventional footwear has extra padding in some of the areas of the upper corresponding to the protrusions to alleviate these ailments. However, the padding wears out over time and becomes less effective in alleviating the ailments. Moreover, the extra padding in conventional footwear is not precisely anatomically positioned for alleviating the ailments.

Another problem associated with conventional footwear is that it does not conform to the structure of the foot because the upper, and the padding in particular, is not shaped like a foot. For example, many conventional shoes have scalloped collars for accommodating the ankle bones. The scallops of the collar are generally symmetric about a longitudinal centerline of the footwear. However, the ankle bones themselves are not symmetric about a longitudinal axis L of the foot. Rather, the tibial protrusion T is above and in front of the fibular protrusion F. As a result, the collar of the shoe does not conform to the protrusions, and the collar either rubs one of the protrusions or it does not support the ankle A. Because conventional footwear is not shaped to accommodate the ankle bones, the ailments discussed above are more likely to occur. The present invention takes into account the structure of the foot to reduce the likelihood of such ailments.

Yet another problem associated with conventional footwear is an ineffectiveness at reducing interstitial fluid build-up and swelling at the ankles A. Such fluid build-up and swelling is a common ailment associated with running, walking, and other physical activity and is caused, in part, by the inability of the lymphatic system to remove interstitial fluids that are produced naturally when tendons, ligaments, and other tissues surrounding the ankle are placed under stress. As a result, swelling occurs. This swelling can be aggravated by the footwear itself, which may constrict the efficient flow of bodily fluids toward the upper body and heart. In any event, a swollen ankle can inhibit movement and be painful. The present invention takes into account the structure of the ankle and the inability of the lymphatic system to remove interstitial fluids to reduce ankle swelling.

SUMMARY OF THE INVENTION

Among the several objects and features of the present invention may be noted the provision of footwear which corresponds to the shape of a foot; the provision of footwear which reduces ailments associated with the protrusions of a foot; the provision of footwear padding which promotes the flow of bodily fluids in the ankle area to reduce swelling; and the provision of footwear which is comfortable to wear.

In general, footwear of this invention comprises a sole for supporting a foot and an upper attached to the sole for covering the foot and adjoining ankle. The sole and upper define an interior of the footwear and is sized and shaped for receiving the foot and ankle. The upper has an outer shell that forms an exterior of the footwear and an inner lining that is adjacent the foot and ankle when they are received in the interior of the footwear. A compressible generally U-shaped pad is positioned between the shell and the lining of the upper. The pad has a bottom section and a pair spaced-apart side sections extending up from the bottom section. The pad is sized and positioned in the upper such that when the foot and ankle are received in the footwear, the bottom section of the pad is disposed immediately below a medial malleolus of the foot and the side sections of the pad extend up along opposite sides of the medial malleolus to at least about a distal neck of the tibia. Upon movement of the foot and ankle in the footwear, the pad is adapted to apply an intermittent pressing force to tissue of the ankle below and at opposite sides of the medial malleolus to reduce swelling of the ankle.

In another aspect, footwear of this invention comprises a sole for supporting a foot and an upper attached to the sole for covering the foot and adjoining ankle. The sole and upper define an interior of the footwear, which is sized and shaped for receiving the foot and ankle. The upper has an outer shell that forms an exterior of the footwear and an inner lining that is adjacent to the foot and ankle when they are received in the interior of the footwear. First and second compressible generally U-shaped pads are positioned between the shell and the lining of the upper. Each pad has a bottom section and a pair spaced-apart side sections extending up from the bottom section. The first pad is sized and positioned in the upper such that when the foot and ankle are received in the footwear its bottom section is disposed immediately below a medial malleolus of the foot and its side sections extend up along opposite sides of the medial malleolus to at least about a distal neck of the tibia. The second pad is sized and positioned in the upper such that when the foot and ankle are received in the footwear its bottom section is disposed immediately below a lateral malleolus of the foot and its side sections extend up along opposite sides of the lateral malleolus to at least about a distal neck of the fibula. Upon movement of the foot and ankle in the footwear, the first pad is adapted to apply an intermittent pressing force to tissue of the ankle below and at opposite sides of the medial malleolus and the second pad is adapted to apply an intermittent pressing force to tissue of the ankle below and at opposite sides of the lateral malleolus to reduce swelling of the ankle.

In yet another aspect, an insert for footwear of this invention comprises a compressible generally U-shaped pad having a bottom section and a pair spaced-apart side sections extending up from the bottom section. The pad is sized for placement in footwear such that when a foot and ankle are received in the footwear the bottom section of the pad is disposed immediately below a medial malleolus of the foot and the side sections of the pad extend up along opposite sides of the medial malleolus to at least about a distal neck of the tibia. Upon movement of the foot and ankle in the footwear, the pad is adapted to apply an intermittent pressing force to tissue of the ankle below and at opposite sides of the medial malleolus to reduce swelling of the ankle.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
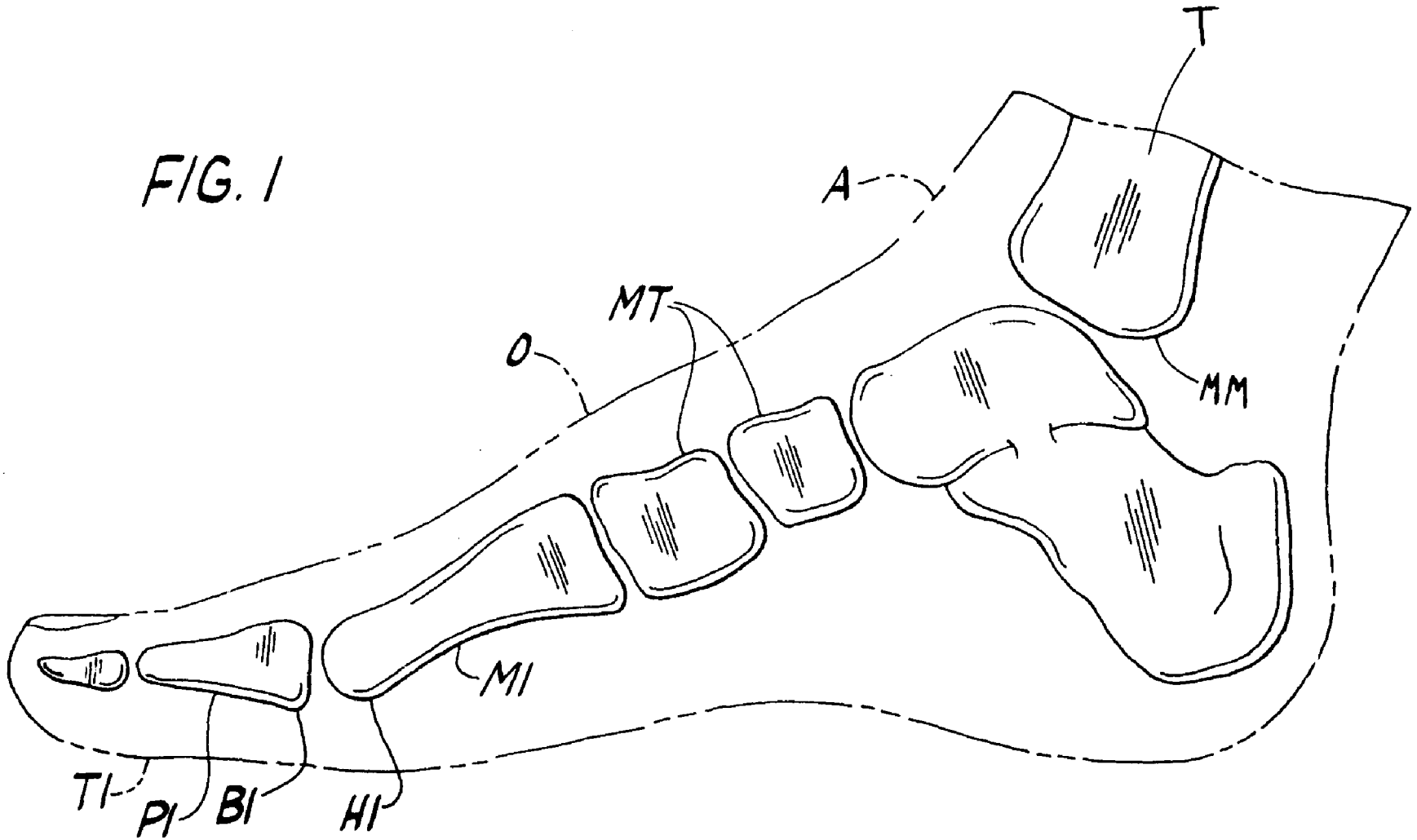
FIG. 1 is a medial side elevation of a foot showing interior skeletal structures.
Figure 2:
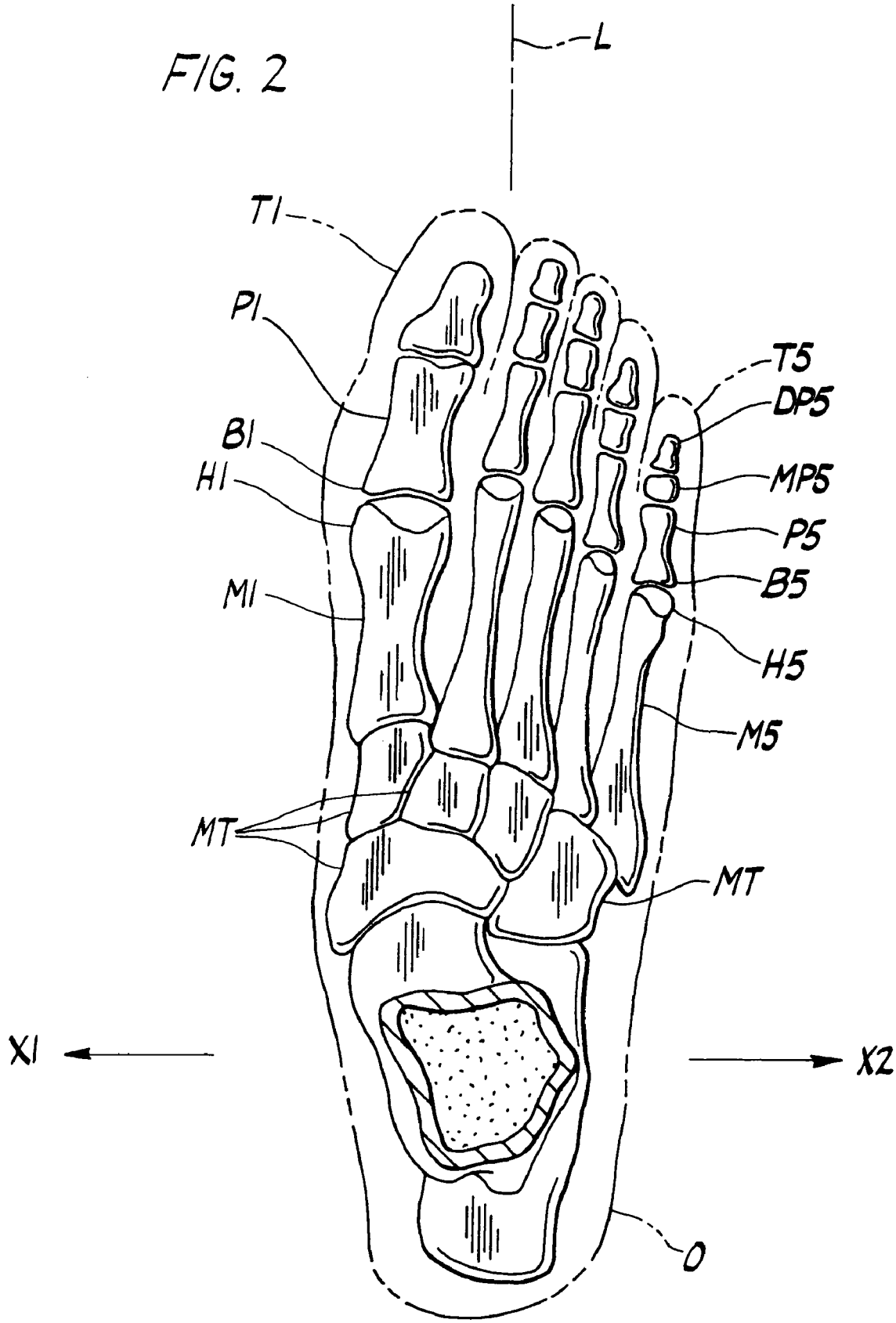
FIG. 2 is a top plan of the foot showing interior skeletal structures.
Figure 3:
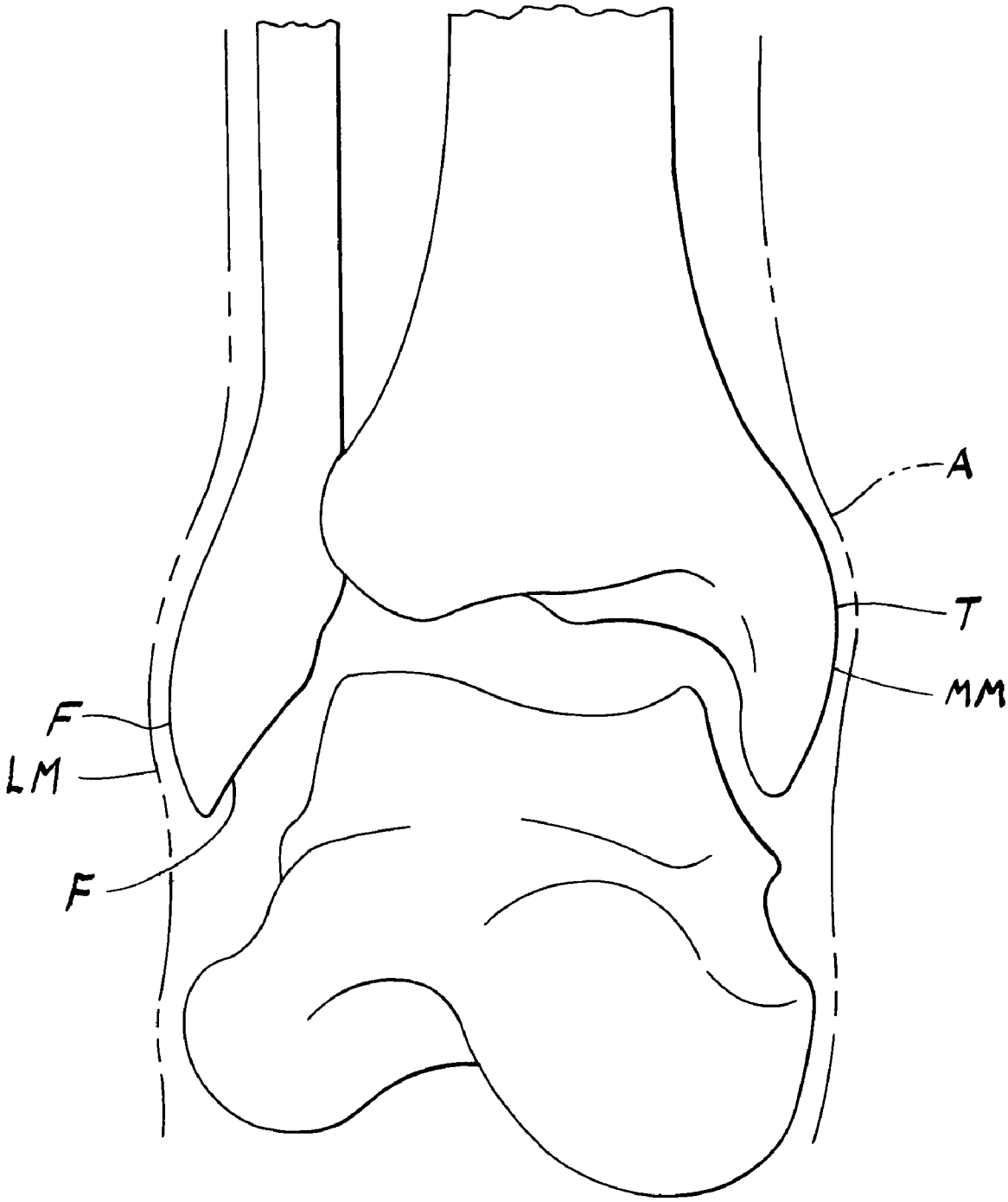
FIG. 3 is a front elevation of an ankle portion of the foot showing interior skeletal structures.
Figure 4:
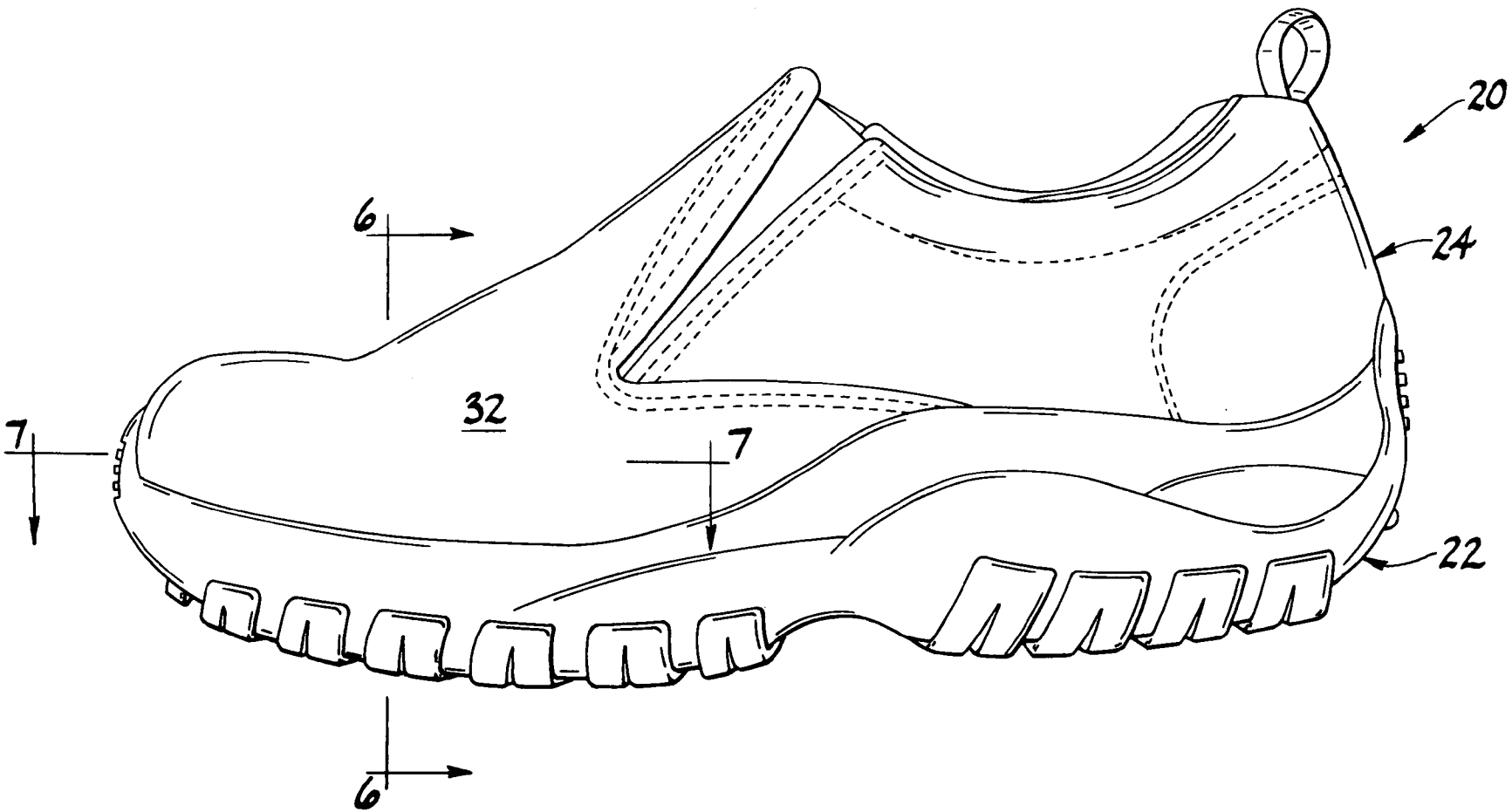
FIG. 4 is a medial side elevation of footwear of a first embodiment of the present invention.
Figure 5:
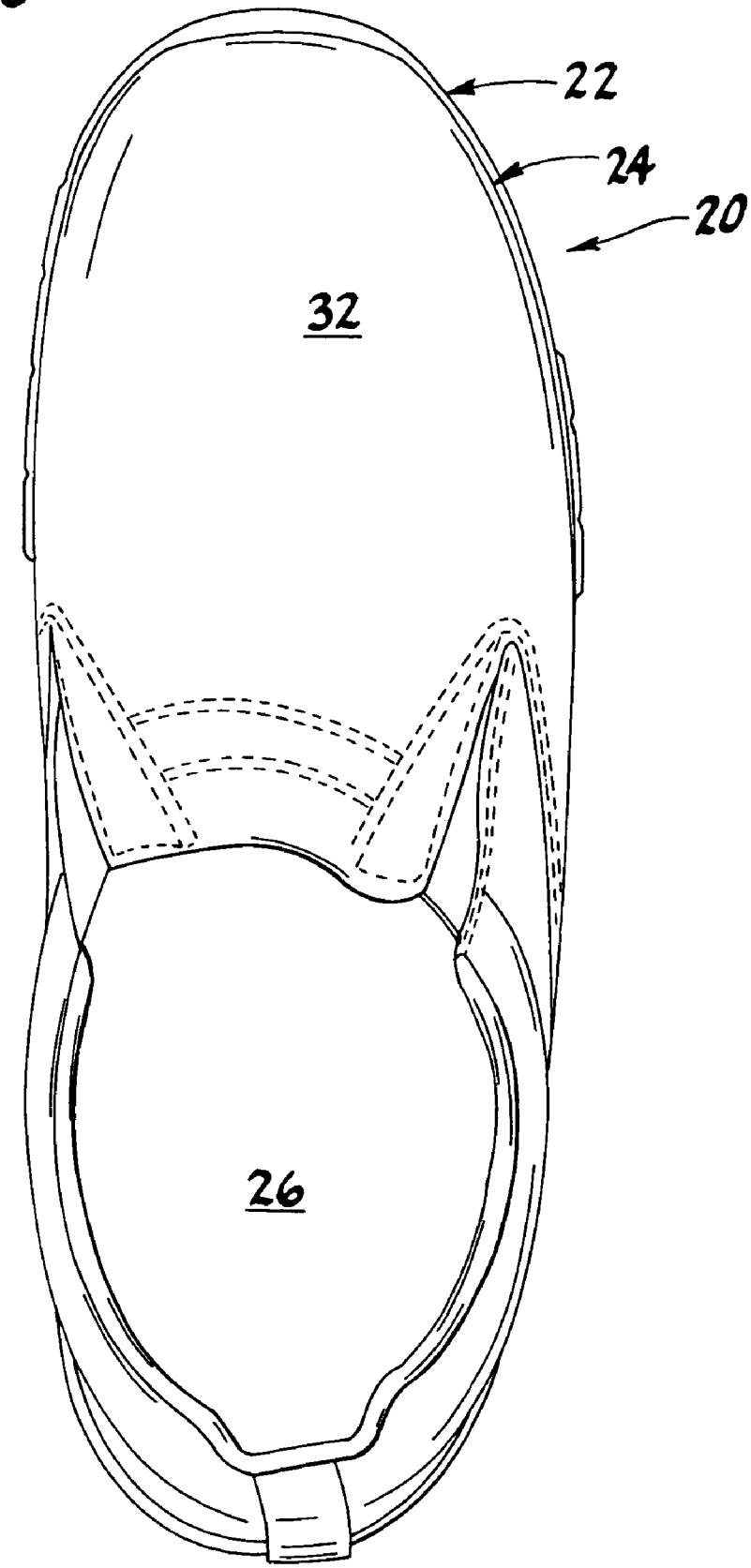
FIG. 5 is top plan of the footwear of the first embodiment.

Referring now to the drawings and in particular to FIGS. 4 and 5, footwear of a first embodiment of the present invention is designated in its entirety by the reference numeral 20. The footwear 20 includes a sole, generally designated by 22, for supporting a foot (not shown) and an upper, generally designated by 24, attached to the sole for covering the foot. As illustrated in FIG. 5, the sole 22 and upper 24 define an interior 26 of the footwear. The interior 26 is sized and shaped for receiving the foot.

Figure 6:
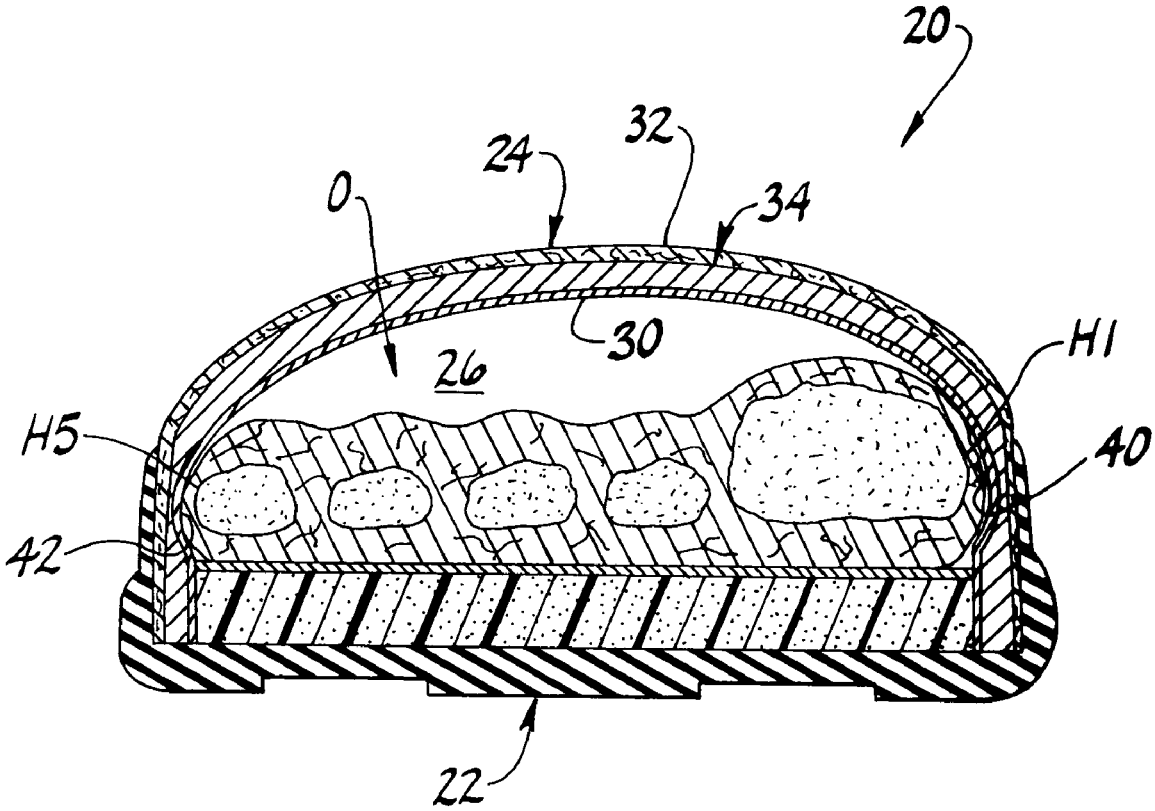
FIG. 6 is cross section of the footwear of the first embodiment taken in the plane of line 6—6 of FIG. 4.

As further illustrated in FIG. 6, the upper 24 includes a lining 30 forming an inner surface of the upper adapted for engaging the foot O when it is received in the interior 26 of the footwear 20. Although the lining 30 may be made of other materials without departing from the scope of the present invention, in the first embodiment the lining is made of cloth. The upper 24 also includes an outer shell 32 forming an outer surface of the upper and an exterior of the footwear 20. Although the shell 32 may be made of other materials without departing from the scope of the present invention, in the first embodiment the shell is made of leather. A compressible cushioning, generally designated by 34, is sandwiched between the lining 30 and the outer shell 32 for permitting the upper 24 to conform to the foot O when it is received in the interior 26 of the footwear 20 to improve the fit of the footwear. Although the cushioning 34 may be made of other materials without departing from the scope of the present invention, in the first embodiment the cushioning is made of an open cell foam. Alternatively, the cushioning 34 may be made of other conventional footwear materials such as gels, closed cell foams and synthetic rubbers. In addition, the lining 30, shell 32 and cushioning 34 may be assembled using any conventional means such as with adhesives or by sewing.

The compressible cushioning 34 is sized, shaped and positioned in the upper to at least partially surround one or more protrusions extending from the foot O. In the first preferred embodiment illustrated in FIGS. 6 and 7, the cushioning 34 at least partially surrounds the first and fifth metatarsal heads H1, H5, respectively, and a portion of a fifth toe T5 corresponding to a portion of a fifth proximal phalanx P5. Further, the cushioning 34 is at least partially omitted from areas on the upper 24 corresponding to these protrusions thereby forming recesses 40, 42 for accommodating the various protrusions to relieve pressure applied to the foot O by the upper at the protrusions.

Figure 7:
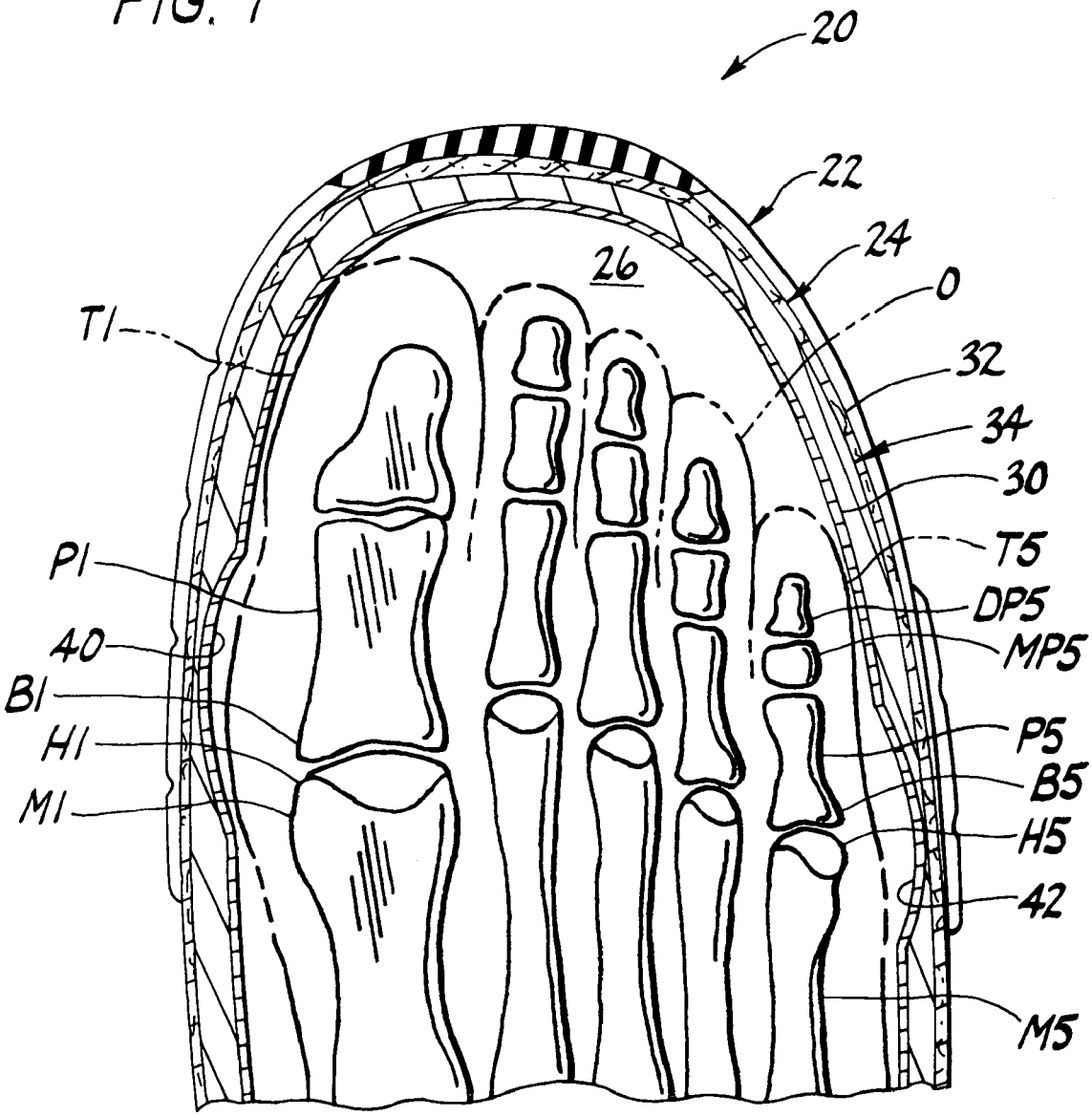
FIG. 7 is cross section of the footwear of the first embodiment taken in the plane of line 7—7 of FIG. 4.

The nominal sizes of the recesses 40, 42 will vary depending upon the size of the foot O. Measurements may be taken to determine the sizes of the recesses 40, 42. As an example, the recess 40 for accommodating the first metatarsal head H1 in footwear 20 sized for a typical adult female (e.g, size 9) is generally oval having a length of about 1¼ to about 1½ inches and a height of about one inch. Further, the recess 40 has a nominal depth of about ⅛ inch. The recess 42 for accommodating the first metatarsal head H1 and the portion of the fifth toe T5 corresponding to the fifth proximal phalanx P5 in footwear 20 sized for a typical adult male (e.g., size 10) is an highly elongate oval having a length of about 1½ to 2 inches and a height of about ½ to about ¾ inches. Further, the recess 42 has a nominal depth of about ⅛ inches. As illustrated in FIGS. 6 and 7, the recesses 40, 42 of the first preferred embodiment have generally rounded shapes and profiles. In addition, the recess 42 may be formed as two separate recesses—one recess for accommodating the head of the fifth metatarsal H5 and one recess for accommodating the fifth proximal phalanx P5.

Figure 8:
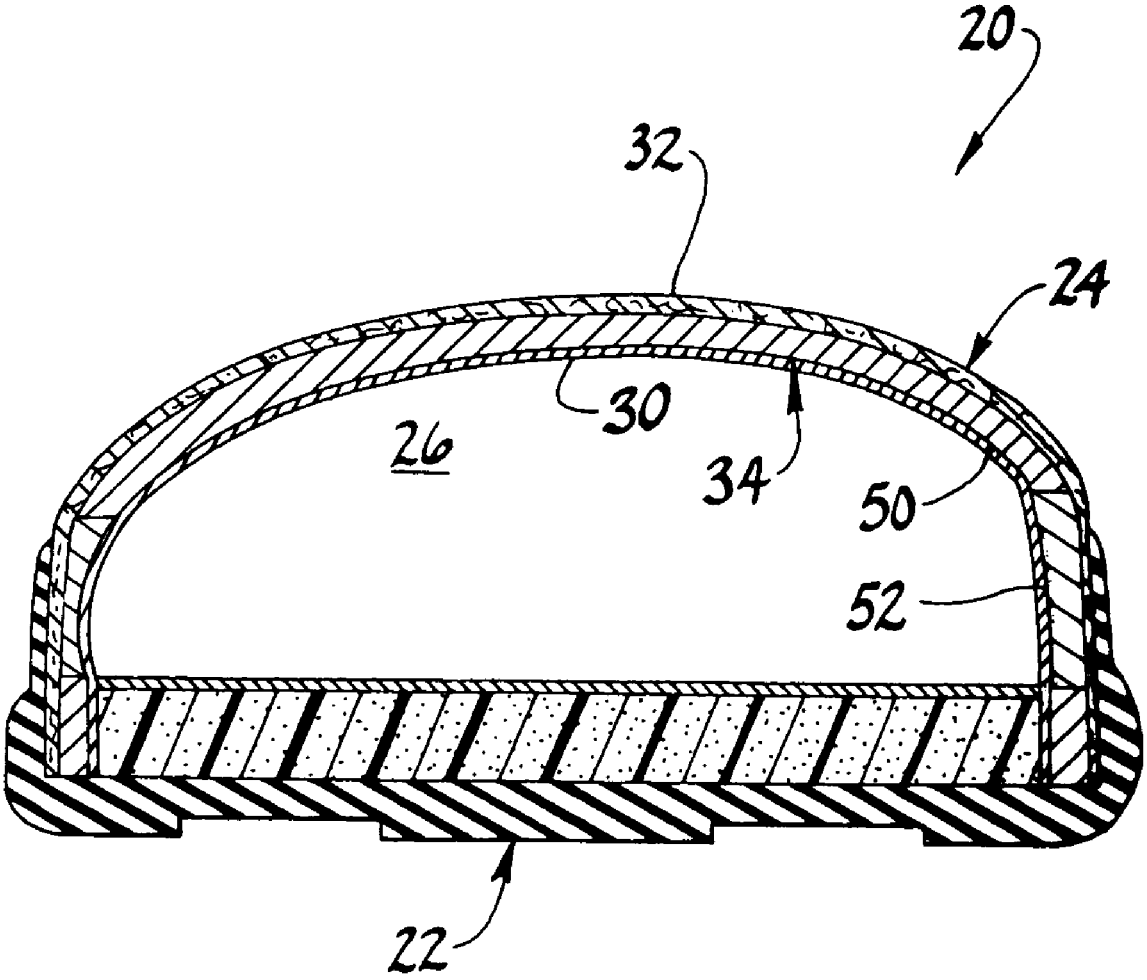
FIG. 8 is cross section of the footwear of a second embodiment taken in the plane of line 6—6 of FIG. 4.
Figure 9:
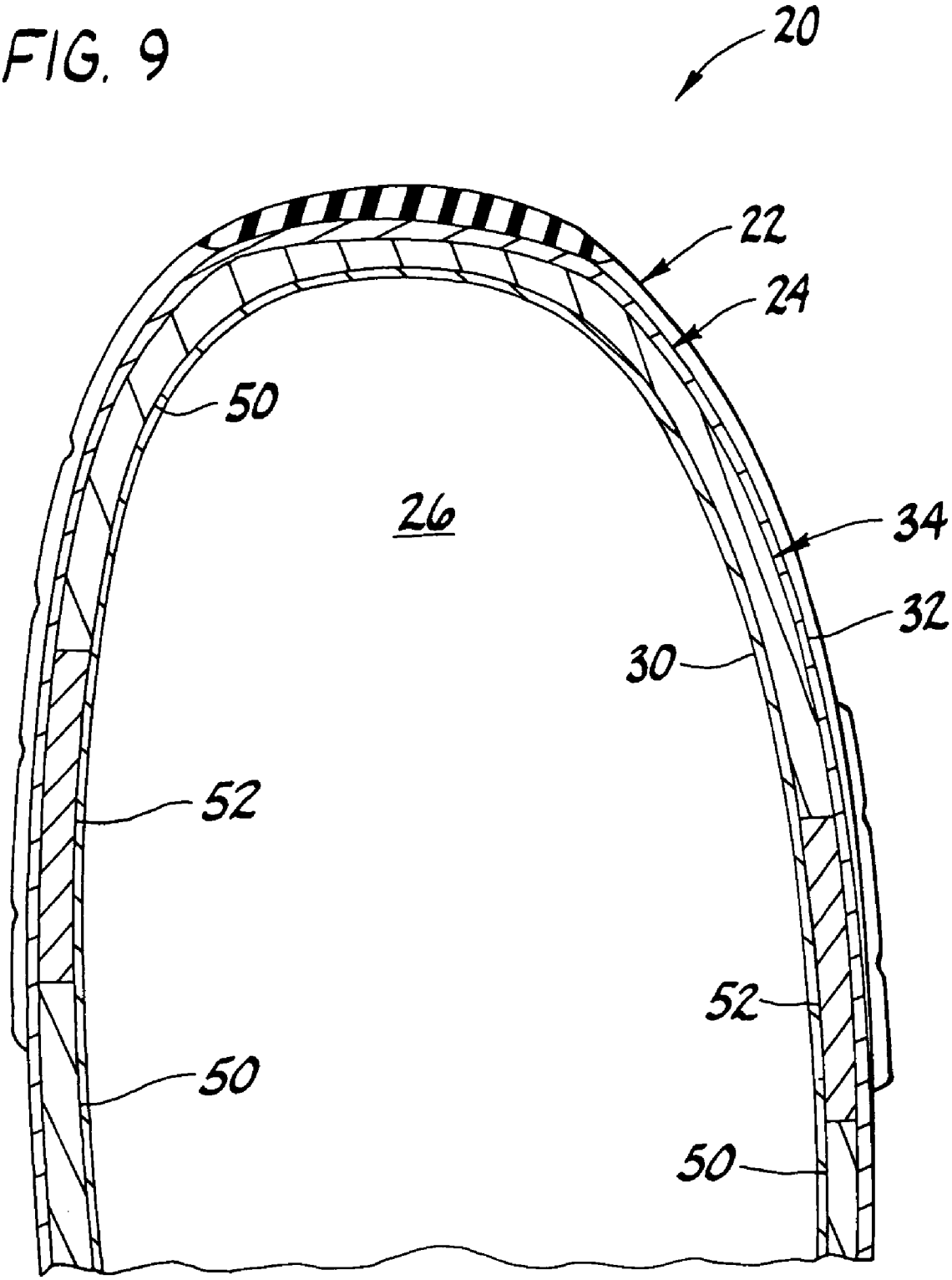
FIG. 9 is cross section of the footwear of a second embodiment taken in the plane of line 7—7 of FIG. 4.

In a second embodiment of the footwear 20 shown in FIG. 8, the cushioning 34 does not have recesses. Rather, the cushioning 34 is made of a softer (i.e., more compressible) material in the areas of the upper 24 which correspond to the protrusions so the cushioning compresses to accommodate the protrusions. Thus, the cushioning 34 is formed from a first material 50 having a first compressibility selected for cushioning corresponding areas of the foot O, and a second material 52 having a second compressibility greater than the first compressibility selected for accommodating corresponding areas of the foot O. The first material 50 is sized, shaped and positioned on the upper 24 for at least partially surrounding the protrusion extending from the foot. The second material 52 is sized, shaped and positioned on an area of the upper 24 corresponding to the location of the protrusion so that the upper applies less pressure to the protrusion than to portions of the foot O surrounding the protrusion. The parts of the upper 24 having the second material 52 are similarly sized, shaped and positioned to the recesses 40, 42 in the footwear of the first embodiment. The first and second materials 50, 52 may have different chemistries from each other or they may have similar chemistries. Where the materials 50, 52 have the same chemistries, they may be integrally formed and the second material may be perforated or otherwise weakened to provide increased compressibility. Other features of the footwear 20 of the second embodiment are similar to those of the footwear of the first embodiment and will not be described in further detail.

Figure 10:
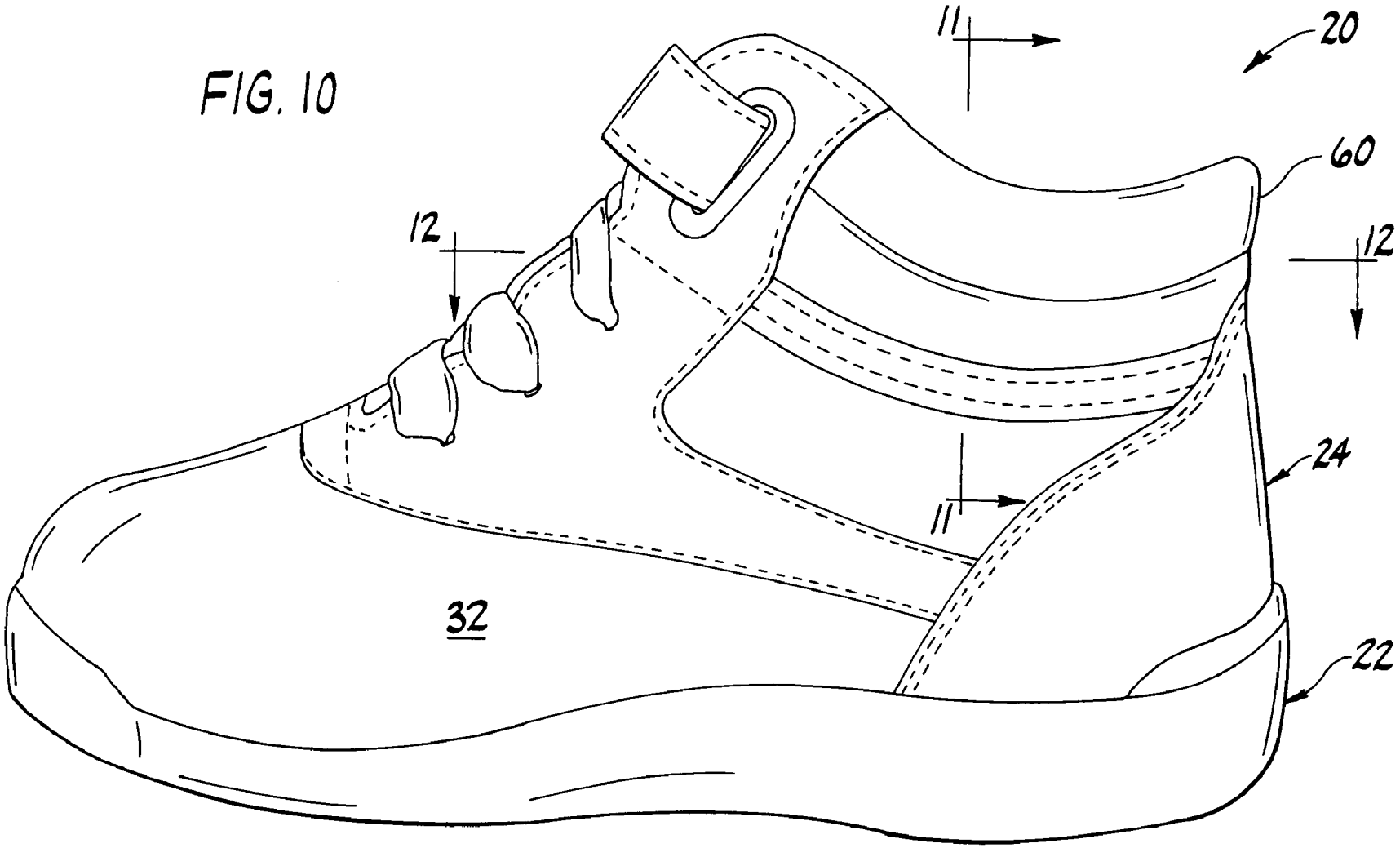
FIG. 10 is a medial side elevation of footwear of a third embodiment of the present invention.
Figure 11:
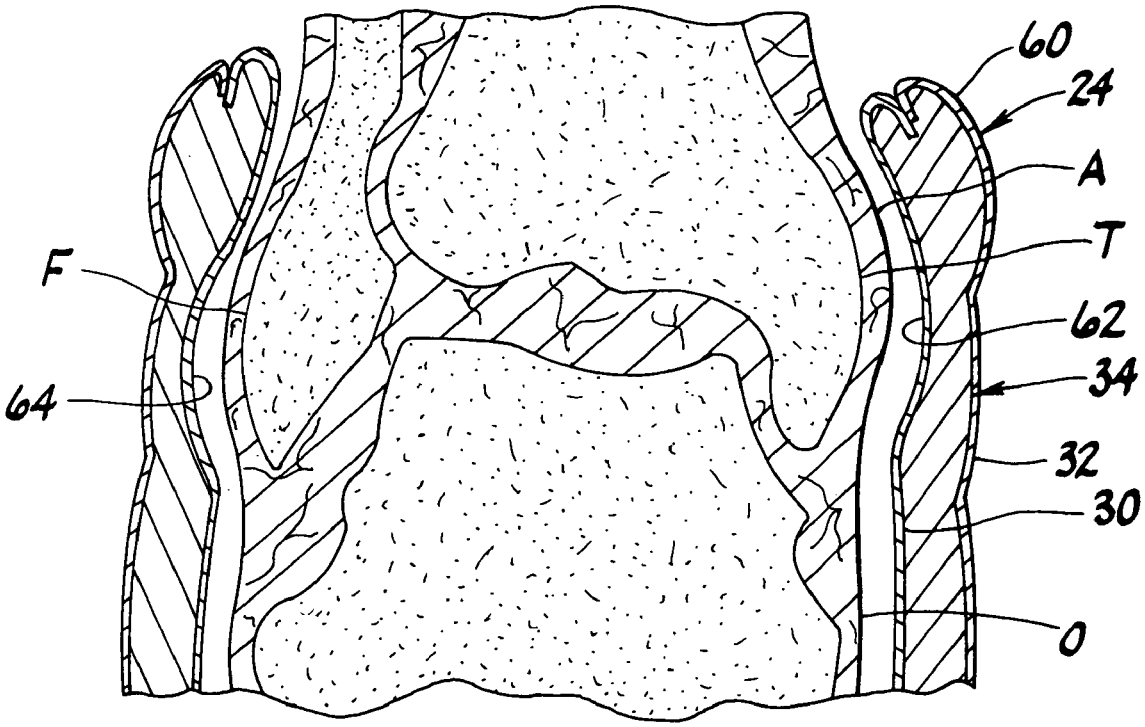
FIG. 11 is cross section of the footwear of the third embodiment taken in the plane of line 11—11 of FIG. 10.
Figure 12:
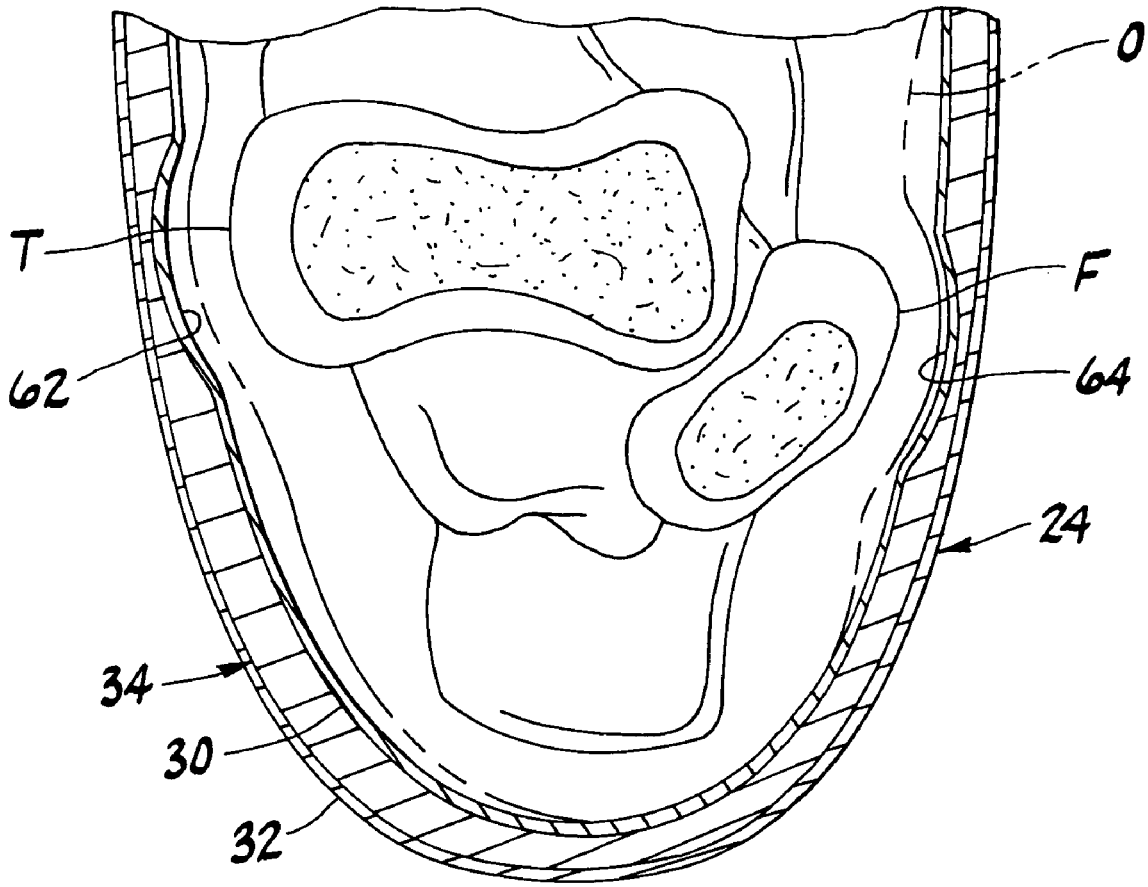
FIG. 12 is cross section of the footwear of the third embodiment taken in the plane of line 12—12 of FIG. 10.

As illustrated in FIGS. 10–12, footwear 20 of a third embodiment has a collar 60 which extends above the distal heads of the tibia T and fibula F. As with the first and second embodiments, the upper 24 of the footwear 20 of the third embodiment has a lining 30, an outer shell 32 and a compressible cushioning 34 is sandwiched between the lining and the outer shell. In addition to the recesses 40, 42 described above with respect to the first embodiment, the cushioning 34 of the footwear 20 of the third embodiment is sized, shaped and positioned in the upper 24 to at least partially surround a medial portion and a lateral portion of an ankle A corresponding to a distal head of a tibia T and a distal head of a fibula F when the foot O is in the interior 26 of the footwear 20. The cushioning 34 is omitted from an area of the upper 24 corresponding to the distal heads of the tibia T and fibular F thereby forming recesses 62, 64 in the upper for accommodating the portions of the ankle A to relieve pressure applied to the ankle by the upper.

The nominal sizes of the recesses 62, 64 will vary depending upon the size of the foot O. As an example, the recess 62 for accommodating the distal head of the tibia T in footwear 20 sized for a typical adult male (e.g., size 10) is generally oval having a length of about 1½ to about 1¾ inches and a height of about 1¼ to about 1½ inches. The recess 64 for accommodating the distal head of the fibula F in footwear 20 sized for a typical adult male is generally oval having a length of about 1 to about 1¼ inches and a height of about 1¼ to about 1½ inches. Further, the recesses 62, 64 has a nominal depth of about ⅛ to about 3/16 inch. Moreover, the fibular recess 64 is preferably below and behind the tibial recess 62. Most preferably, the fibular recess 64 is offset from the tibial recess 62 by a distance of about ½ to about ¾ inches measured in a horizontal plane as shown in FIG. 12, and by a distance of about ½ to about ¾ inches in a vertical plane as shown in FIG. 11. Further, it is envisioned that the upper portions of the cushioning 34 and the recesses 62, 64 may be omitted in footwear 20 having a low collar 60. It is also envisioned that the recesses 62, 64 may have open bottoms forming openings through the upper 24 for accommodating the corresponding portion of the ankle without departing from the scope of the present invention.

Although the cushioning 34 surrounding the various portions of the foot O is illustrated as being unitary, those skilled in the art will appreciate that the cushioning may be formed from more than one piece and/or in more than one layer without departing from the scope of the present invention. Further, the cushioning 34 of the third embodiment may be made from two materials similarly to the cushioning of the second embodiment without departing from the scope of the present invention. Still further as will be appreciated by those skilled in the art, the areas of the upper 24 corresponding to the protrusions preferably do not contain seams to avoid abrasiveness, inelasticity and stiffness in these areas.

Figure 13:
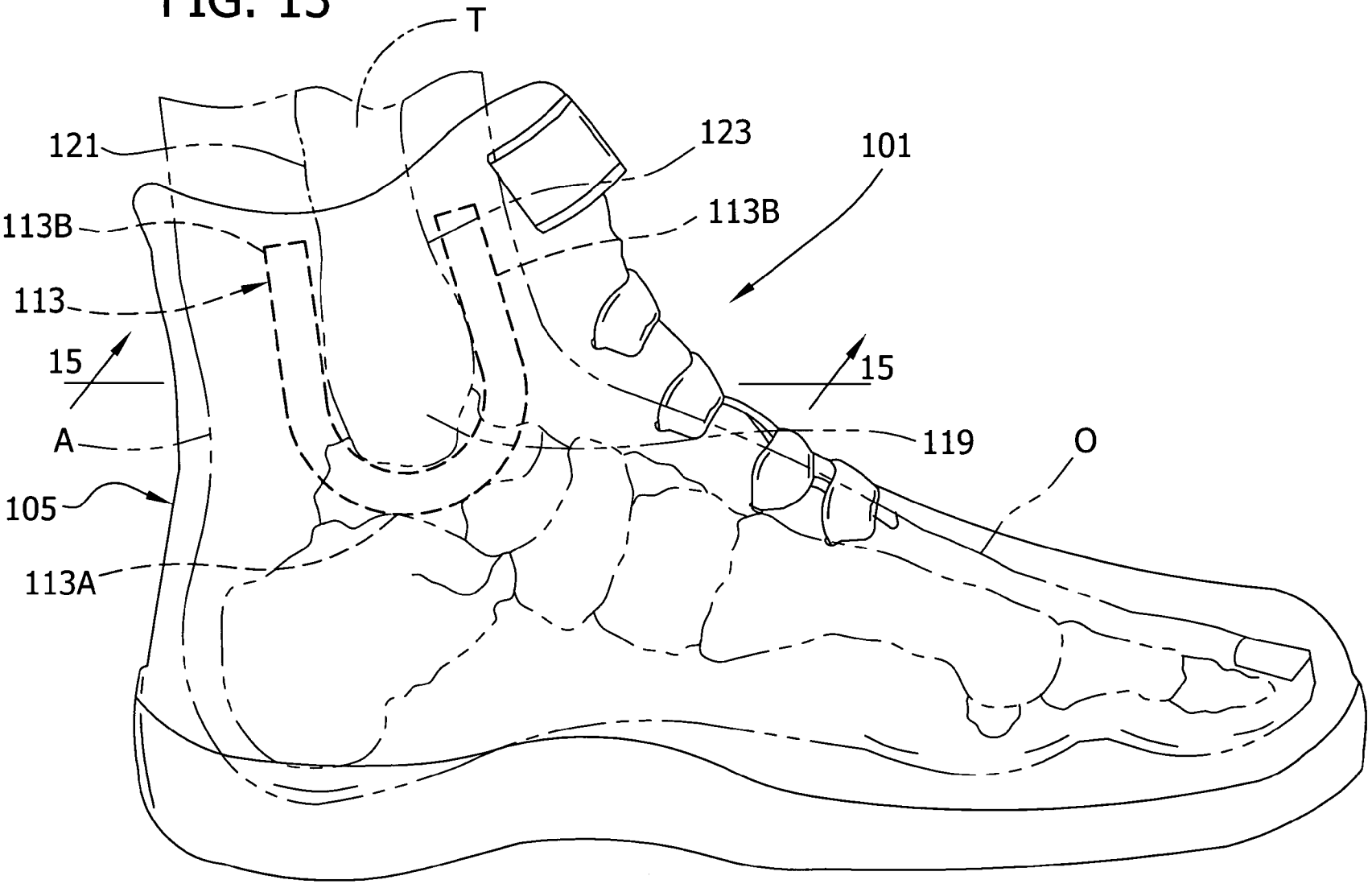
FIG. 13 is a medial elevation of one embodiment of footwear of this invention incorporating a medial ankle pad to reduce ankle swelling.
Figure 14:
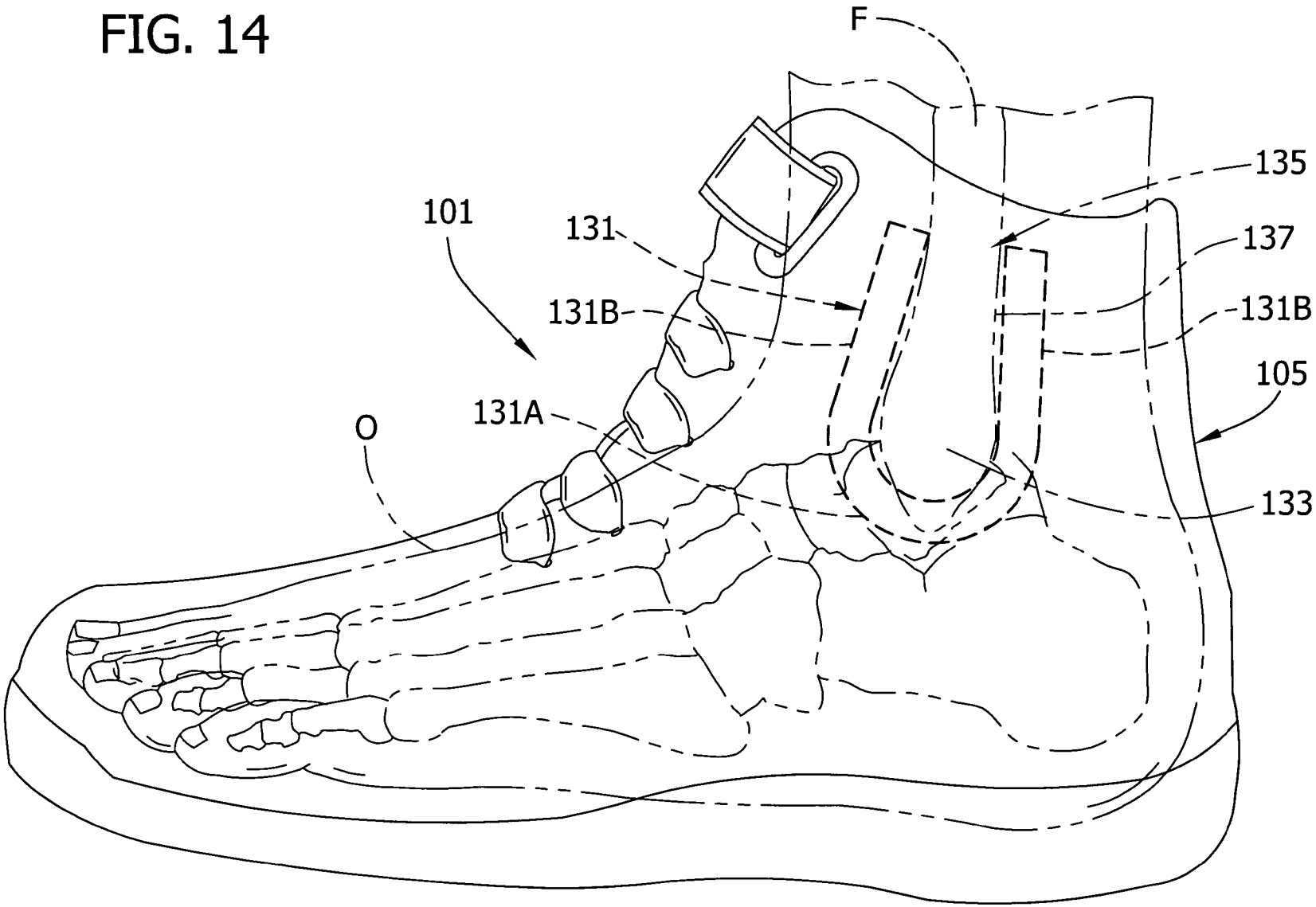
FIG. 14 is a lateral elevation of the footwear of FIG. 13 incorporating a lateral ankle pad to further reduce ankle swelling.
Figure 15:
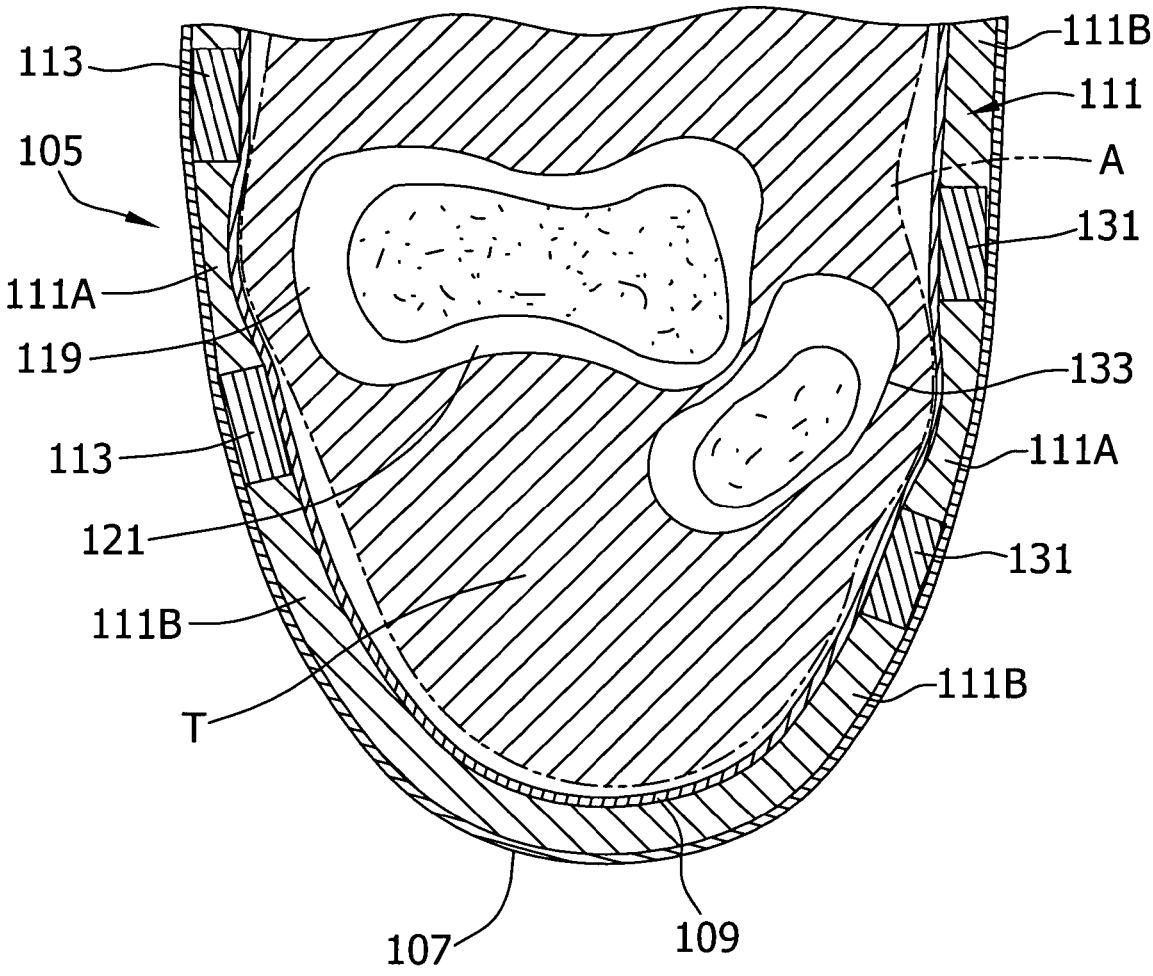
FIG. 15 is a horizontal cross-sectional view on line 15—15 of FIG. 13.

FIGS. 13–15 show footwear, generally designated 101, incorporating one or more ankle pads of this invention. The footwear 101 comprises an upper 105 having an outer shell 107 of conventional material (e.g., leather, cloth), an inner lining 109 of conventional material (e.g., cotton fabric, synthetic material, Gortex®), and a filler material 111 (e.g., conventional cotton or foam filler material) between the shell and lining. In accordance with one aspect of this invention, a medial ankle pad 113 is also sandwiched between the lining and the shell. The pad 113 (FIG. 13) has a bottom section 113A and a pair of spaced-apart side sections 113B extending up from the bottom section. As illustrated, the pad 113 is U-shaped with a curved bottom section 113A and substantially straight side sections 113B, but other configurations are possible. The pad 113 is of a firm but resiliently compressible material and is sized and positioned within the upper 105 of the footwear such that when the foot and ankle are received in the footwear, the bottom section 113A of the pad is disposed immediately below the medial malleolus 119 of the tibia 121 of the leg, and the side sections 113B of the pad extend up along opposite sides of the medial malleolus to a level generally at or above the distal neck 123 of the tibia, i.e., the location where the shaft of the tibia meets the medial malleolus. The particular embodiment shown in FIG. 13 advantageously has a curved bottom section 113A to conform to the lower end of the medial malleolus 119, but it will be understood that the bottom section can have other shapes so long as the bone structure of the tibia below the distal neck 123, including the medial malleolus 119, is received within the U-recess of the ankle pad 113 and the pad is positioned for applying pressure to the surrounding tissue all the way up to about at least the distal neck 123 of the tibia, as will be described.

The ankle pad 113 is of a resiliently compressible material such as Poron® cellular urethane foam having a firmness which is sufficient to apply an intermittent compressive force to the tissue surrounding the medial malleolus 119 and distal neck 123 of the tibia 121 during motion of the foot, as during walking and running. In one embodiment, the ankle pad has a Shore C durometer in the range of 25–70, the magnitude of which may vary depending on the particular type of shoe. For example, in a children's shoe, where the pressure to be applied to the tissue is less, the durometer of the pad 113 may be in the range of 25–36 Shore C; for an athletic shoe the durometer may be in the range of 37–55 Shore C; and for a heavy boot (e.g., military or construction) the durometer may be in the range of 60–70 Shore C. For good functionality, the filler material 111A on the inside of the U-pad, i.e., the filler material between the side sections 113B of the U-pad (see FIG. 15) should be softer and have a resistance to compression less than that of the U-pad 113 itself. In one embodiment, for example, the inside filler material 111A has a durometer at least 10 units less than the durometer of the pad 113 (e.g., 10–15 durometer units less on the Shore C scale). The filler material 111B on the outside of the pad 113 may have a hardness the same as, or less than, or greater than the hardness of the pad 113. The inside and outside filler materials 111A, 111B may have the same composition or be of different compositions. The inside filler material 111A may have a thickness less than that of the U-pad 113. Alternatively, the inside filler material 111A may be omitted entirely. The outside filler material 111B may have a thickness the same as or less than the thickness of the U-pad 113. The filler material between the outer shell 107 and inner lining 109 in the heel area of the footwear may be constructed as a conventional heel counter.

In use, the footwear 101 is preferably secured relatively tightly on the foot so that the U-pad 113 is pressed snugly against the tissue below and on opposite sides of the medial malleolus 119 and on opposite sides of the distal neck 123 of the tibia 121. As a result, when a user of the footwear 101 walks, runs, or engages in similar activity so that the foot and ankle move within the footwear, the pad 113 intermittently applies pressure against the medial side of the ankle A and tissue T surrounding the medial malleolus 119 and distal neck 123 of the tibia to simulate a pumping or milking action. This intermittent application and release of pressure forces interstitial fluids accumulating in the ankle area into the lymphatic system where the fluids are transported away from the ankle A toward the upper part of the body and the heart. Consequently, swelling of the ankle due to walking, running, or similar activity is reduced. Additionally, swelling of the ankle due to periods of immobility, e.g. long periods of sitting, is more effectively reduced after the user resumes walking or running.

As shown in FIG. 15, the footwear 101 also includes a second (lateral) pad 131 sandwiched between the lining 109 and the outer shell 107 at the lateral side of the ankle to further increase the removal of interstitial fluid from the ankle area. The lateral pad 131 is preferably similar to the first (medial) pad 113, being generally U-shaped and having a bottom section 131A and a pair of spaced-apart side sections 131B extending up from the bottom section (see FIG. 14). This pad 131 is also of a firm but resiliently compressible material having a hardness and resistance to compression greater than that of the inside filler material 111A, as discussed above regarding the medial U-pad 113. The lateral pad 131 may be constructed of the same material as the medial pad 113 and have the same durometer hardness and resistance to compression as that noted above. The U-pad 131 is sized and positioned within the footwear 101 such that when the foot O and ankle A are received in the footwear and the footwear is secured on the foot relatively tightly, the bottom section 131A of the pad is disposed immediately below the lateral malleolus 133 of the fibula 135 of the foot and the side sections 131B of the pad extend up along opposite sides of the lateral malleolus to a level generally at or above the distal neck 137 of the fibula. Like the first pad 113, the bottom section 131A of the medial pad 131 shown in FIG. 14 is curved to conform to the lateral malleolus 133. However, it will be understood that the bottom section 131A can have other shapes. Significantly, the bone structure of the fibula below the distal neck 137, including the lateral malleolus 133, is received within the U-recess of the ankle pad 131 and the pad is positioned for applying pressure to the surrounding tissue all the way up to at least the distal neck 137 of the fibula. When the footwear is secured relatively tightly on the foot, the lateral pad 131 functions in the same manner as the medial pad 113 (i.e., creates a pumping action against the tissue surrounding the lateral malleous and distal neck of the fibula during foot movement) to reduce swelling of the ankle.

While the footwear 101 described above has both medial and lateral pads 113, 131, it will be understood that footwear of this invention could include only one of these pads at either side of the foot.

The size of the U-pads 113 and 131 will vary depending on the size of the footwear and person wearing it. In general, however, the size should be such that the U-shape of each pad relatively closely conforms to the distal neck of the respective tibia and fibula and associated medial and lateral malleolus. In this regard, the spacing between the side sections 113B of the medial U-pad 113 generally corresponds to the width of the lower end of the medial malleolus 119, and the spacing between the side sections 131B of the lateral U-pad 131 generally corresponds to the width of the lower end of the lateral malleolus 137. Also, due to the anatomy of the foot in general, the medial pad 113 is typically located forward and above the lateral pad 131. The side sections of each pad 113, 131 should extend up to at least about the distal neck of the respective tibia and fibula, as noted above.

It is contemplated that one or both of the pads 113, 131 described above will be made as an integral part of the footwear 101 during the manufacturing process. However, it is contemplated that pad(s) could be sold separate from the footwear and retrofitted in the footwear at a later date.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. Footwear comprising a sole for supporting a foot, an upper attached to the sole for covering the foot and adjoining ankle, said sole and upper defining an interior of the footwear sized and shaped for receiving the foot and ankle, said upper having an outer shell forming an exterior of the footwear, an inner lining adjacent the foot and ankle when they are received in the interior of the footwear, and a compressible generally U-shaped pad positioned between the shell and the lining of the upper, said pad having a bottom section and a pair spaced-apart side sections extending up from the bottom section, said pad being sized and positioned in the upper such that when the foot and ankle are received in the footwear the bottom section of the pad is disposed immediately below a medial malleolus of the foot and the side sections of the pad extend along opposite sides of the medial malleolus up to at least about a distal neck of the tibia whereby upon movement of the foot and ankle in the footwear the pad is adapted to apply an intermittent pressing force to tissue of the ankle below and at opposite sides of said medial malleolus to reduce swelling of the ankle, and inside tiller material between the shell and lining and between the side sections of the pad, said pad having a hardness and resistance to compression greater than that of said inside filler material.

2. Footwear as set forth in claim 1 wherein the spacing between said side sections of the pad generally corresponds to the width of the lower end of the medial malleolus.

3. Footwear as set forth in claim 1 wherein the bottom section of the pad is curved to conform to the lower end of the medial malleolus.

4. Footwear as set forth in claim 1 wherein said inside filler material has a hardness at least 10 durometer units on the Shore C scale less than the hardness of said pad.

5. Footwear as set forth in claim 1 wherein said pad has a Shore C durometer in the range of 25–70.

6. Footwear as set forth in claim 1 wherein said pad is an integral part of the footwear.

7. Footwear comprising a sole for supporting a foot, an upper attached to the sole for covering the foot and adjoining ankle, said sole and upper defining an interior of the footwear sized and shaped for receiving the foot and ankle, said upper having an outer shell forming an exterior of the footwear, an inner lining adjacent the foot and ankle when they are received in the interior of the footwear, and first and second compressible generally u-shaped pads positioned between the shell and the lining of the upper, each of said first and second pads having a bottom section and a pair spaced-apart side sections extending up from the bottom section, said first and second pads being sized and positioned in the upper such that when the foot and ankle are received in the footwear the bottom section of the first pad is disposed immediately below a medial malleolus of the foot and the side sections of the first pad extend along opposite sides of the medial malleolus up to at least about a distal neck of the tibia, and the bottom section of the second pad is disposed immediately below a lateral malleolus of the foot and the side sections of the second pad extend along opposite sides of the lateral malleolus up to at least about a distal neck of the fibula, whereby upon movement of the foot and ankle in the footwear the first pad is adapted to apply an intermittent pressing force to tissue of the ankle below and at opposite sides of said medial malleolus and the second pad is adapted to apply an intermittent pressing force to tissue of the ankle below and at opposite sides of said lateral malleolus to reduce swelling of the ankle, and inside filler material between the shell and lining and between side sections of the first and second pads, said pads having a hardness and resistance to compression greater than that of said inside filler material.

8. Footwear as set forth in claim 7 wherein the spacing between said side sections of the first and second pads generally correspond to the width of the lower end of the medial malleolus and to the width of the lower end of the lateral malleolus, respectively.

9. Footwear as set forth in claim 7 wherein the bottom sections of the first and second pads are curved to conform to the lower end of the medial malleolus and to the lower end of the lateral malleolus, respectively.

10. Footwear as set forth in claim 7 wherein said inside filler material between the side sections of each pad has a hardness at least 10 durometer units on the Shore C scale less than that of said pad.

11. Footwear as set forth in claim 10 wherein said pad has a Shore C durometer in the range of 25–70.

12. Footwear as set forth in claim 7 wherein said first and second pads are integral parts of the footwear.

* * * * *